US006120312A

United States Patent [19]

Shu

[11] Patent Number: 6,120,312

[45] Date of Patent: Sep. 19, 2000

[54] LIGHT EMITTED DIODE LIGHT BULB HOLDER USED IN LED TYPE CHRISTMAS LIGHT BULB STRING

[76] Inventor: Kuo Fen Shu, No. 10, Lane 198, Chung Cheng Road, Hsinchu, Taiwan

[21] Appl. No.: 09/426,891

[22] Filed: Oct. 26, 1999

[51] Int. Cl.[7] ..... H01R 13/267

[52] U.S. Cl. ..... 439/356; 362/226; 439/699.2

[58] Field of Search ..... 439/699.2, 699.1, 439/336, 356, 617, 228, 229, 230, 235, 414, 419; 362/226

[56] References Cited

U.S. PATENT DOCUMENTS

| | | | |
|---|---|---|---|
| 4,181,390 | 1/1980 | Aizawa | 339/65 |
| 4,727,648 | 3/1988 | Savage, Jr. | 29/839 |
| 5,368,503 | 11/1994 | Savage, Jr. | 439/502 |
| 5,588,863 | 12/1996 | Wu | 439/356 |
| 5,707,138 | 1/1998 | Pan | 362/226 |
| 5,722,860 | 3/1998 | Pan | 439/619 |
| 5,795,189 | 8/1998 | Liou | 439/602 |
| 5,820,419 | 10/1998 | Liao | 439/699.2 |

*Primary Examiner*—Paula Bradley
*Assistant Examiner*—Phuongchi Nguyen
*Attorney, Agent, or Firm*—Rosenberg, Klein & Lee

[57] ABSTRACT

A light emitted diode (LED) light bulb holder used for LED type Christmas light bulb strings comprise specially designed terminals that are used in conjunction with an insertion element to effectively hold leads of a light emitted diode and to firmly connect the LED light bulb with the holder. Thus the insertion element, the terminals and electrical wires seated in a holder body can provide an excellent effect of connecting LED light bulbs with electrical wires.

3 Claims, 7 Drawing Sheets

LIGHT EMITTED DIODE LIGHT BULB HOLDER USED IN LED TYPE CHRISTMAS LIGHT BULB STRING

BACKGROUND OF THE INVENTION

Incandescent bulbs used in a conventional Christmas light bulb string produce heat and result in high temperature, which provides inconvenience in use. Thus light emitted diodes are used in place of conventional light bulbs in Christmas light bulb strings. However, light emitted diodes currently used in Christmas decorative light bulb strings are simply substitutes for conventional incandescent bulbs. They used a holder structure that was designed for conventional light bulbs. Due to the limitation of LED structures, those conventional holders brought much inconvenience in use and assemblage to users and manufacturers when they were used for LED light bulbs. The conventional structure often leads to a poor electrical connection between the leads of a light bulb diode light bulb and electrical wires. This is primarily because that the leads of a light emitted diode is made of a different material that is often thicker and harder than the leads of a conventional light bulb. Further, the leads of a light emitted diode is often coated with a layer of electroplated material. This makes the leads of a light emitted diode unable to be bent like an incandescent light bulb. If the leads were bent by forces, the electroplated layer will break and the metal underneath the coated layer will be exposed to the outside. Finally metal oxidization occurs. Besides, conventional light bulb holder structures also bring trouble to assembling work and provide a poor electrical connection between LED light bulbs and electrical wires.

Accordingly, it is the primary object of the invention to provide an improved holder structure for LED light bulbs used in Christmas light bulb strings, in which the drawbacks of a conventional structure have been eliminated by using specially designed insertion elements and terminals of electrical wires. Now the structural features and advantages of the invention will be detailed with reference to the accompanying drawings.

BRIEF DESCRIPTION OF ACCOMPANYING DRAWINGS

DETAILED DESCRIPTION OF PREFERRED EMBODIMENTS

Figure 1:
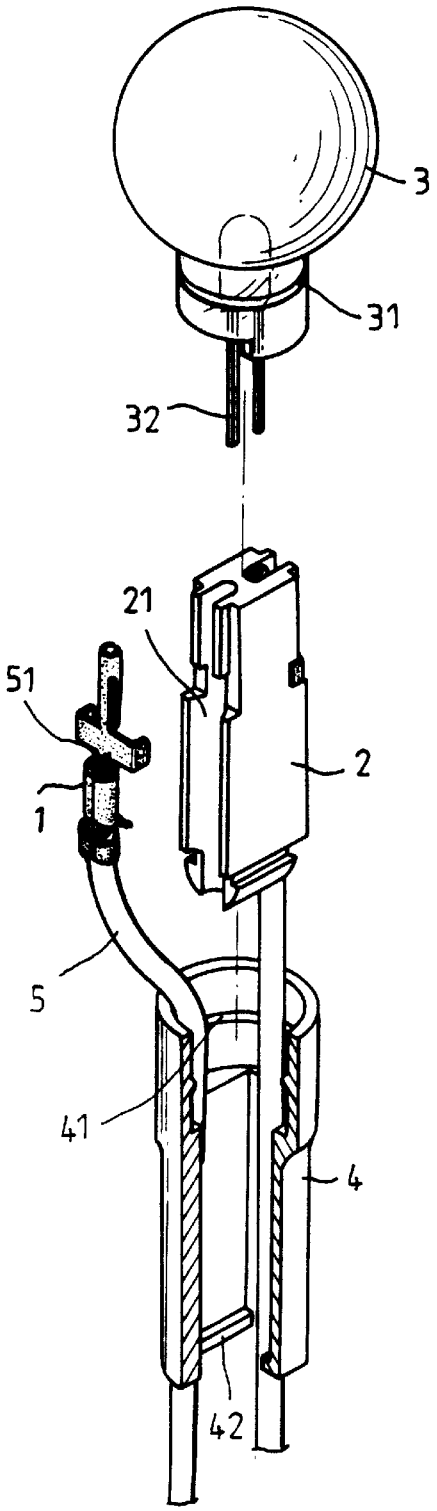
FIG. 1 is a partially cutaway, exploded view of an embodiment of the light bulb holder according to the invention.
Figure 2:
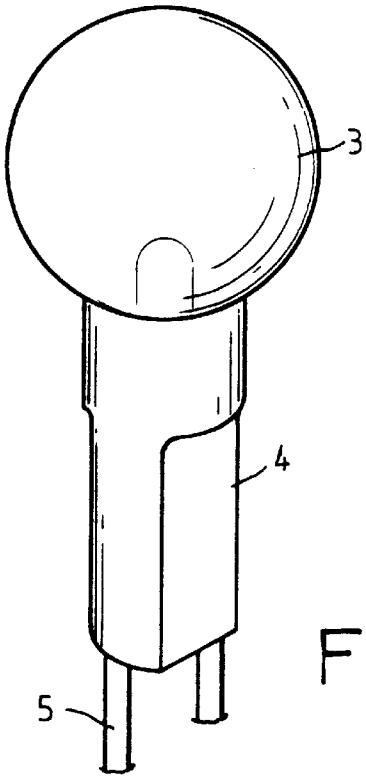
FIG. 2 is a perspective view showing the outer appearance of the light bulb holder of FIG. 1 in an assembled state.
Figure 3:
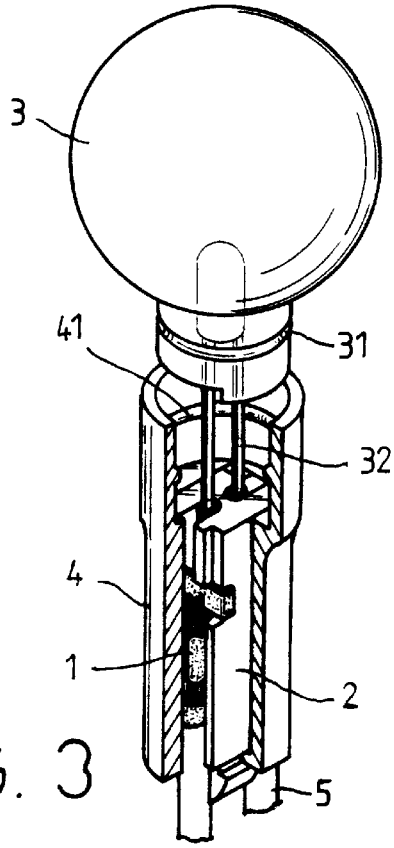
FIG. 3 is a partially cutaway view of the light bulb holder of FIG. 2.
Figure 4:
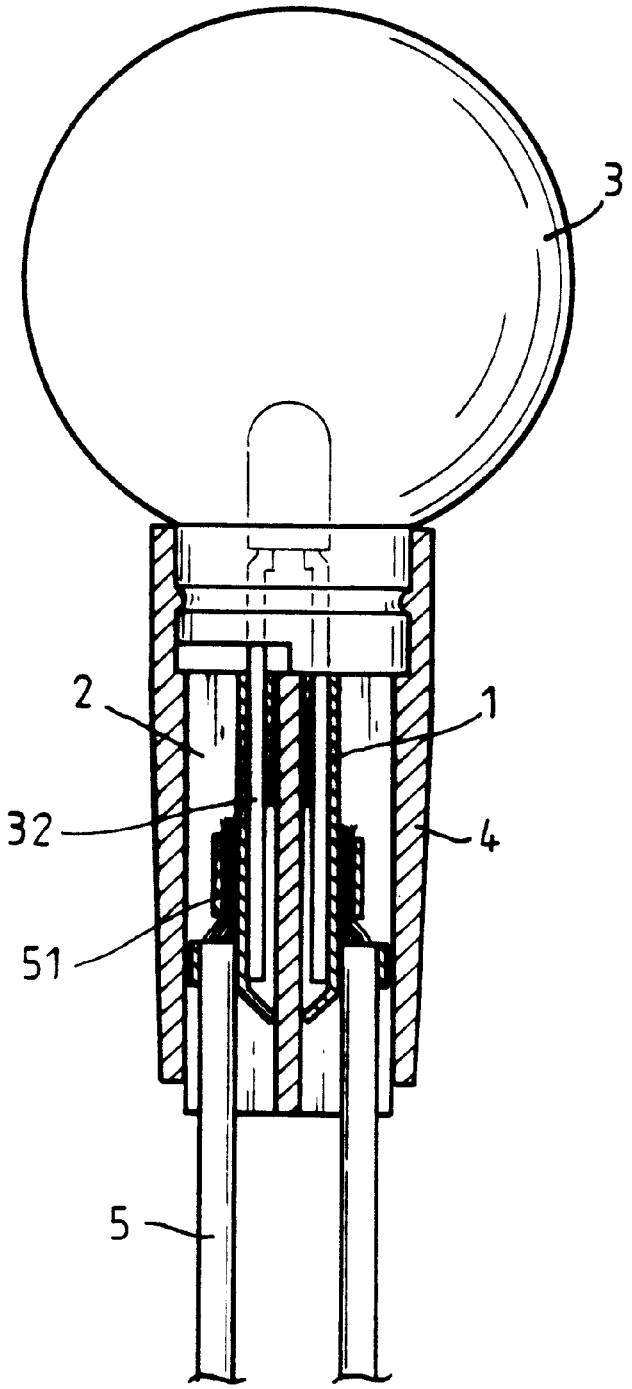
FIG. 4 is a cross sectional view of the light bulb holder of FIG. 2.

As shown in FIGS. 1 through 4, the light bulb holder according to the invention comprises a holder body (4) accommodating a light bulb (3) on the top thereof, and an insertion element (2) housed in the holder body (4). The insertion element (2) is equipped on each of two opposite sides with a slot (21). Each slot (21) receives a terminal (1). The light bulb (3) is furnished on the cylindrical surface of the lower portion with an annular groove (31) (or an annular bump). The light emitted diode (LED) inside the light bulb (3) has two straight leads extending vertically downwards. The holder body (4) comprises an annular flange (41) on the internal wall surface near the upper opening corresponding to the annular groove (31) of the light bulb (3), or an annular groove if the corresponding portion on the light bulb (3) is provided with an annular bump. The annular flange (41) (or the annular bump) of the holder body (4) is designed as coupling and locating means to engage with the annular groove (31) (or the annular bump) of the light bulb (3) when the LED light bulb (3) is mounted on the holder body (4). Thus the light bulb (3) and the holder body (4) can be joined in an easy way. Furthermore, the holder body (4) is provided on the lower end rim with inward protrusions (42).

Figure 5:
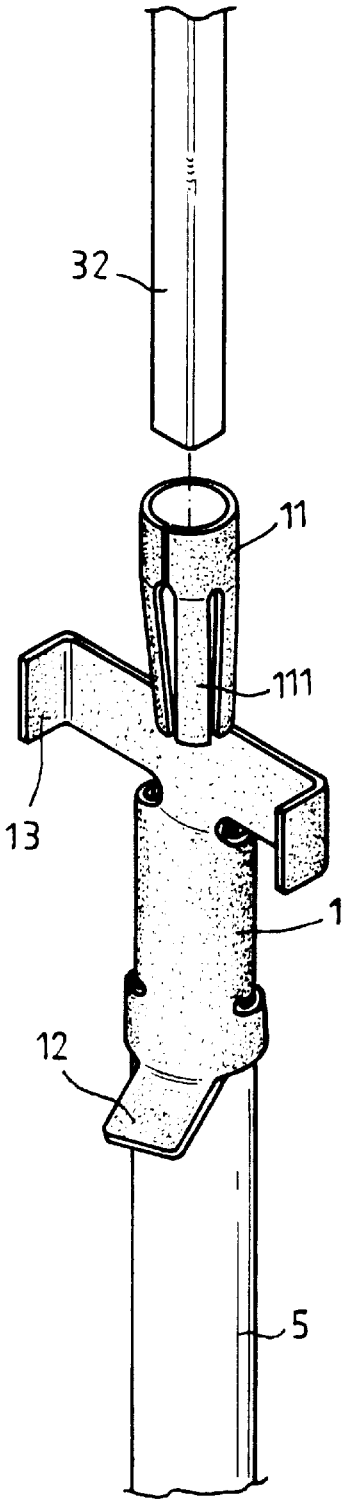
FIG. 5 is a partial enlarged view showing the terminals of the invention.
Figure 6:
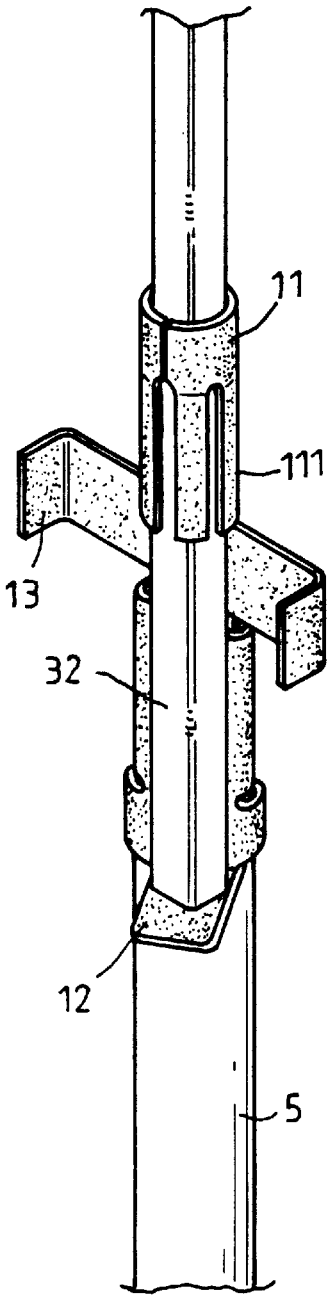
FIG. 6 is another perspective view showing the connection of the terminals with the leads of a light emitted diode.

The present invention is featured by the design of terminals (1). Referring to FIGS. 5 and 6, the upper portion of the terminal (1) is a tube (11). The tube (11) is configured to have a straight duct portion on the upper portion. The cylindrical wall of the straight duct portion extends downwards and splits on the lower portion into several spaced elastic fingers (111), which inwardly obliquely extend to define a reduced duct portion. The inside diameter of the straight duct portion of the tube (11) is slightly larger than the thickness of the leads (32) of the LED light bulb (3). However, the inside diameter of the reduced duct portion gradually reduces from the top to the bottom until a diameter slightly smaller than the lead thickness of a light emitted diode. Provided on the middle segment of the terminal (1) are two bent tabs (13) respectively extending towards opposite sides of the terminal (1). Distance between the bent portions of two tabs (13) is dimensioned to be slightly smaller than the thickness of the insertion element (2). The lower portion of the terminal (1) can firmly embrace the bared end (51) of an electrical wire (5) to form a dependable electrical connection. The lower end of the terminal (1) is further provided with a slant tab (12). Two terminals (1) each associated with an electrical wire (5) are individually inserted into two slots (21) of the insertion element (2), with the bent tabs (13) holding the body of the insertion element (2). Then the insertion element (2) is placed into the holder body (4), with an extension of the protrusions (42) into two latch elements (22) formed on the lower end of the insertion element (2). In this way, the holder of the invention can achieve a sturdy structure.

The leads (32) of the LED (3) are inserted into terminals (1) through the tubular portion (11) until the lower end of the leads gets in touch of the slant tab (12) while the elastic fingers (111) are biased outwardly as shown in FIG. 6 so that the terminal can provide an excellent electrical connection and stable support.

Figure 7:
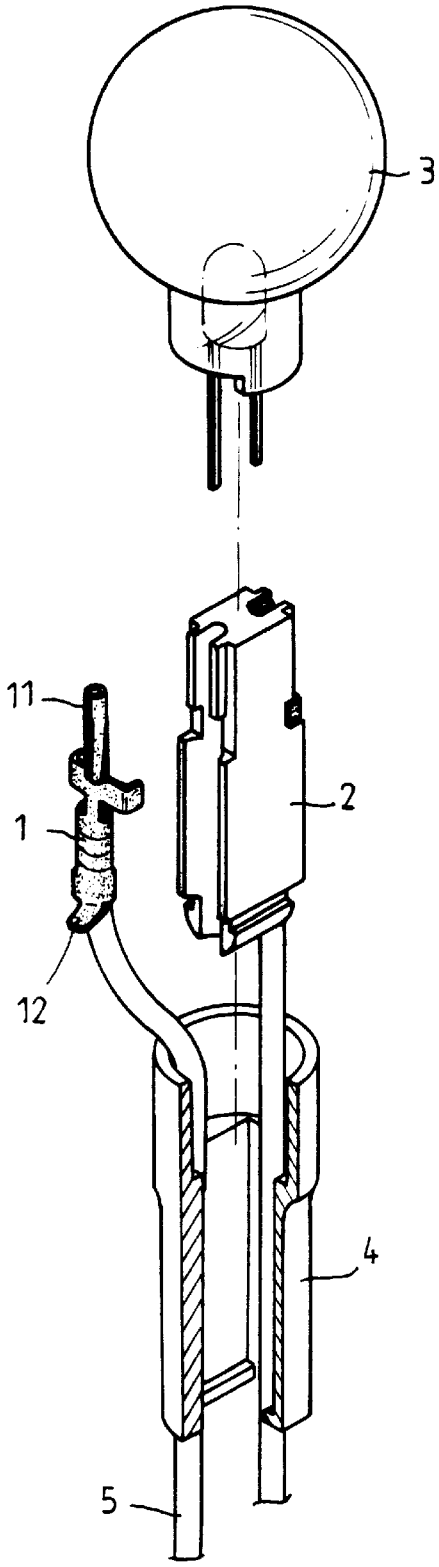
FIG. 7 shows an alternative embodiment of the light bulb holder according to the invention.
Figure 8:
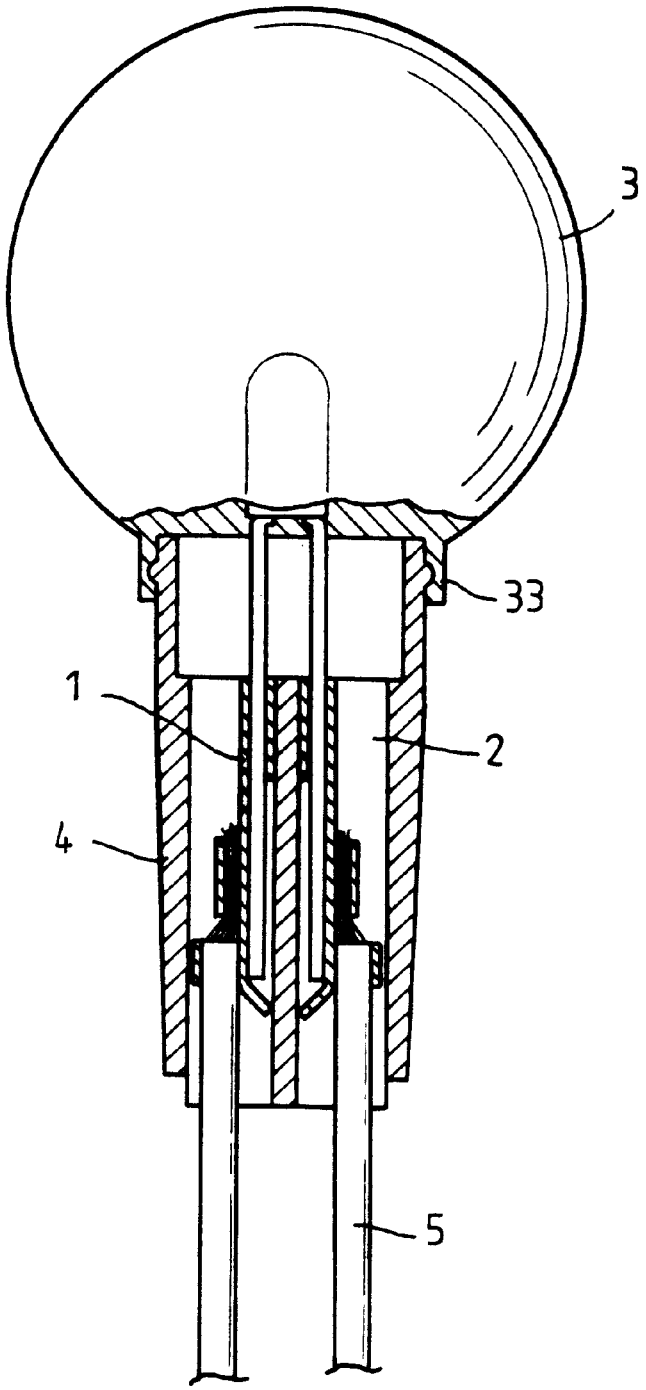
FIG. 8 shows another alternative embodiment of the light bulb holder according to the invention.
Figure 9:
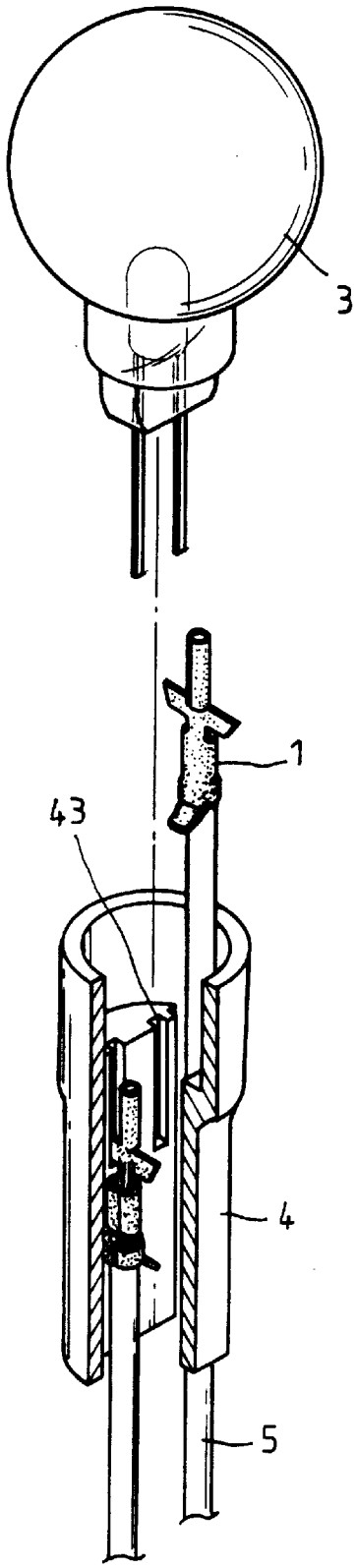
FIG. 9 shows the third alternative embodiment of the light bulb holder according to the invention.

Accordingly, with the above arrangement, the invention indeed has the essence of a patent. Although the present invention has been described in relation to particular embodiments, it is not limited in any way thereby but is capable of modifications and variants without deviation from the scope of the invention defined by the claims below. As an illustrative example, FIG. 7 shows another form of the terminal (1) in which the orientations and positions of the tubular portion (11) and the slant tab (12) have been changed. FIG. 8 indicates another embodiment, in which the outer shell (33) of the LED light bulb (3) is provided on the lower rim with such annular grooves that it can be mounted over the top of the holder (4) instead of being seated in the holder. Besides, the structure of the invention can be further simplified by using slots (43) formed on the interior of the holder body as a substitute for the insertion element to accommodate terminals (1) as shown in FIG. 9.

What is claimed is:

1. An improved LED light bulb holder structure comprising a holder body accommodating an insertion element and a pair of terminals associated with electrical wires as well as receiving a LED light bulb on the top thereof, wherein said LED light bulb is furnished on the cylindrical surface of the lower portion thereof with an annular groove or bump that is engaged with a corresponding annular flange or groove formed on the inner wall surface of said holder body;

said insertion element is equipped on two opposite sides with a slot that receives said terminal therein;

said terminals individually have a tube disposed on the upper portion, two bent tabs formed on the middle portion, means on the lower portion embracing the bared end of an electrical wire and a slant tab extending from the lower end;

said tube being configured to have on the upper portion thereof a straight duct portion having an inside diameter slightly larger than the thickness of the leads of the LED light bulb and on the lower portion thereof a reduced duct portion that is defined by a plurality of inwardly inclined elastic fingers and that gradually reduces from the top to the bottom until its inner diameter is slightly smaller than the lead thickness of the LED light bulb, said bent tabs each extending towards two opposite sides, with the bent portion thereof separated from each other by a distance slightly smaller than the thickness of said insertion element, said terminals each associated with an electrical wire being inserted into the slots on two opposite sides of said insertion element, with two bent tabs holding the body of the insertion element, and then the insertion element being slid into the holder body until it being caught in position by an engagement of the inwardly projecting lower rim of the holder with two latch elements formed on the lower end of the insertion element.

2. The improved LED light bulb holder structure as claimed in claim 1 wherein the engagement means provided on the lower portion of said LED light bulb and the inner wall surface of said holder body can be either an annular recessed groove or raised bump, or two or more annular grooves or bumps as required.

3. The improved LED light bulb holder structure as claimed in claim 1 wherein the engagement means provided on the lower portion of said LED light bulb and the inner wall surface of said holder body can be recessed or raised dots.

* * * * *